United States Patent [19]

Müller

[11] 4,451,161

[45] May 29, 1984

[54] MOVEMENT FOR AN ELECTRONIC WATCH WITH ANALOGUE DISPLAY

[75] Inventor: Jacques Müller, Reconvilier, Switzerland

[73] Assignee: ETA S.A. Fabriques d'Ebauches, Switzerland

[21] Appl. No.: 257,278

[22] Filed: Apr. 24, 1981

[30] Foreign Application Priority Data

Apr. 25, 1980 [CH] Switzerland ..... 3193/80

[51] Int. Cl.[3] ..... G04B 19/02; G04B 29/00

[52] U.S. Cl. ..... 368/220; 368/322

[58] Field of Search ..... 368/76, 80, 220, 88, 368/322–324

[56] References Cited

U.S. PATENT DOCUMENTS 4,079,582 3/1978 Tamaru et al. ..... 368/76
4,090,352 5/1978 Jeanhet et al. ..... 368/220
4,274,153 6/1981 Kume et al. ..... 368/220
4,296,488 10/1981 Nakayama ..... 368/80
4,335,454 6/1982 Yamada ..... 368/220

*Primary Examiner*—Vit W. Miska
*Attorney, Agent, or Firm*—Allegretti, Newitt, Witcoff & McAndrews, Ltd.

[57] ABSTRACT

In the movement for an electronic watch with analogue display, hand-carrying arbors 20, 22 have pinions 20*a*, 22*a* of very small diameter, rather than wheels. The cell 10 has a diameter which is substantially equal to the radius of the movement plate 2, since the cell extends from the periphery of the movement up to the pinions 20*a*, 22*a*. The wheels 28, 30, 34, 40, 42 which drivably connect the motor 8 to the pinions 20*a*, 22*a* are arranged in such a manner that there is no overlapping between the cell 10 and the wheels. This makes possible a movement which is both of small diameter and thin.

2 Claims, 3 Drawing Figures

MOVEMENT FOR AN ELECTRONIC WATCH WITH ANALOGUE DISPLAY

BACKGROUND OF THE INVENTION

The present invention relates to a compact movement for an electronic watch with analogue display, the movement comprising at least one cell feeding a motor and a train of working parts transmitting motion from the motor to minute and hour arbors.

It is known that, in all electronic watches with analogue display, the most bulky component is the cell which supplies the electrical energy necessary for the functioning of the watch. The diameter of the cell, which is usually cylindrical, determines the radial dimension of the movement containing the cell. In addition, it is known that the arbors, which carry the minute and hour hands respectively and which occupy the central region of the space containing the movement, are associated with gear wheels at least one of which, namely the hour wheel, is of substantial diameter. Consequently, the dimension of the movement in the radial direction which contains the cell is determined not only by the diameter of the cell but also by the radius of the wheel which is fixed to the hour arbor.

A first solution of the problem of reducing the radius of the watch movement is to locate the great wheel or hour wheel above or below the cell, so that it overlaps the cell. This makes it possible to produce a circular movement the radius of which is substantially equal to the diameter of the cell. However, this solution has the concomitant disadvantage that it produces an increase in the thickness of the movement and hence of the watch, so that such a disposition is in practice inapplicable to ladies watches. In order to avoid this increase in thickness, another solution consists in giving the movement an elongate form. This precludes the use of a circular shape which is often in demand for ladies watches.

BRIEF SUMMARY OF THE INVENTION

In order to avoid the above-described disadvantages, it is an object of the invention to make possible the provision of a circular electronic watch movement which is of small thickness and diameter, with the radius of the movement substantially equal to the diameter of the cell and with the movement substantially equal to that of the cell.

According to the present invention, there is provided a movement of an electronic watch with analogue display and having substantially the shape of a circular cylinder, comprising at least a cell, a motor supplied by the cell, a minute hand and an hour hand, arbors provided with gears and carrying the hands, the arbors being coaxial with the cylinder, and movable working parts for transmitting motion from the motor to the gears on the arbors, the projection of the cell on to a cross-sectional plane of the cylinder intersecting a radius of the cylinder at two points separated by a distance substantially equal to the length of the radius and the projections on to the said plane of the said working parts and of the gears on the hand-carrying arbors being located wholly outside the projection of the cell.

It is thus clear that not only can the diameter of the cell be substantially equal to the radius of the watch movement, but also the thickness of the watch movement can be substantially equal to that of the cell since there is no overlapping between the cell and the working parts concerned which are either movable motion-transmitting parts or working parts fixed to the hand-carrying arbors.

BRIEF DESCRIPTION OF THE DRAWINGS

Embodiments of the invention will now be described by way of example with reference to the accompanying drawings, in which.

DETAILED DESCRIPTION OF THE PREFERRED EMBODIMENTS

Figure 1:
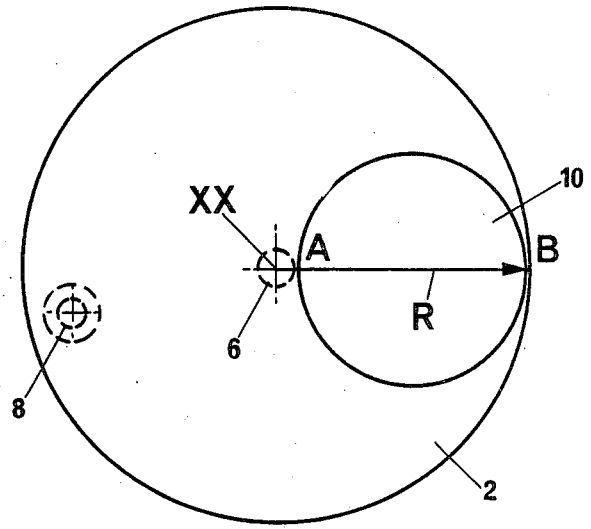
FIG. 1 is a diagrammatic top plan view of a watch movement, illustrating the principal characteristics of the invention.

In FIG. 1 there is shown a circular plate 2 which determines the cylindrical shape of the movement. This figure also indicates diagrammatically the central geometrical axis XX of the plate 2 which is coincident with the geometrical axis of the arbors carrying the minute and hour hands. Also indicate diagrammatically in FIG. 1 is the space 6 occupied by the pinions associated with the hour and minute arbors. Furthermore, FIG. 1 indicates diagrammatically the electric motor 8 of the movement and the cell 10, but does not show the motion work by means of which the motor 8 drives the pinions of the hour and minute arbors. This motion work will be described in detail later with reference to FIG. 2. It is sufficient to know that all the wheels and pinions of this motion work, when projected on to the plane of the figure, lie outside the projection of the cell 10 on to the same plane.

It is also clear from FIG. 1 that the cell 10, which is usually of cylindrical shape, has a diameter substantially equal to the radius of the watch movement 2. In other words, if one considers the radius R of the movement, one will observe that this radius interesects the projection of the cell on to the plate 2 at two points A and B which are separated by a distance substantially equal to the length of the radius R of the movement. As will be explained later, this arrangement is made possible by the use of a gear train of a particular type and by the fact that the invention uses, for driving the minute arbor and the hour arbor, pinions of very small diameter. It is in fact the diameter of these pinions which determines the space that is left for the accommodation of the cell 10, if overlapping of the movable parts and the cell is to be avoided.

Figure 2:
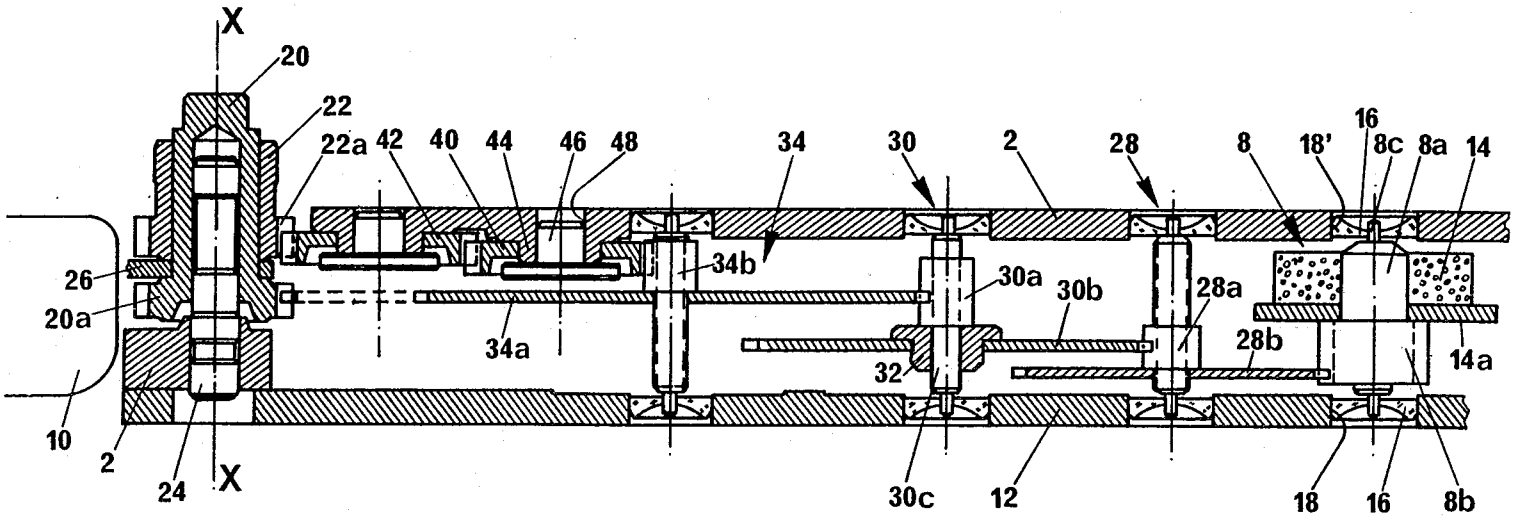
FIG. 2 is a vertical section of a part of the watch movement, showing the working parts between the motor and the arbors.

The plate 2 and a bridge plate 12 of the movement are shown in FIG. 2. Within the space delimited by these two plates is mounted a motor 8 which has in known manner a rotor 8*a* provided with a magnet 14 supported on a platform 14*a*. The rotor 8*a* is extended by a pinion 8*b*. Journals 8*c* on the ends of the rotor shaft are mounted in bearings 16 that are force fitted in openings 18 and 18′ formed in the plate 2 and the bridge plate 12 respectively. Also shown in FIG. 2 are a minute arbor 20 and an hour arbor 22 through which the central axis XX of the watch movement extends. The minute arbor 20 is constituted by a closed-ended tube rotatably mounted on a fixed axis pin 24 which is rigid with the plate 2. The arbor 20 is provided with a minute pinions 20*a*. The hour arbor 22, which is hollow and surrounds part of the minute arbor 20, is constituted by a cannon wheel the pinion of which is indicated by the reference 11*a*. An hour hand and a minute hand are mounted in known manner on the arbors 22 and 20 respectively. There is arranged between the two arbors 20, 22 a washer 26 which serves only for maintaining the minute arbor 20 in position when it is necessary to turn the movement over in order to proceed for example with tests of the motor torque.

The pinions 20*a* and 22*a* are of equal external diameter and this external diameter differs very little from the external diameter of the arbor 22, the difference being substantially equal to the depth of the gear teeth. In other words, the pinions 20*a* and 22*a* have a diameter which is as small as possible. It will then be understood that, due to this arrangement, a distance A-B substantially equal to the radius r of the movement is available for the reception of the cell 10.

FIG. 2 illustrates one possible arrangement of the gear train of the motion work which enables the rotational movement of the rotor 8*a* of the motor 8 to be transmitted to the pinions 20*a* and 22*a* on the minute and hour arbors. This gear train comprises a first intermediate wheel 28 rotatably mounted in bearings and comprising a pinion 28*a* as well as a wheel 28*b* which is in mesh with the pinion 8*b*. This first intermediate wheel 28 drives a second intermediate wheel 30 which likewise comprises a pinion 30*a* and a wheel 30*b*. However, the wheel 30*b* is mounted on an arbor 30*c* via a friction coupling 32 which enables the hour indicated by the watch to be reset without affecting the motor 8. This second intermediate wheel 30 is drivably connected to the minute wheel 34 which comprises a minute wheel 34*a* and an hour pinion 34*b*. The minute wheel 34*a* is arranged, as indicated in broken lines, so that it is in mesh with the minute pinion 20*a*. The hour pinion 34*b* is drivably connected with the pinions 22*a* on the hour arbor via two idler wheels 40 and 42. The idler wheel 40 is mounted for rotation on a boss 44 on the plate 2 and is retained on this boss 44 by the enlarged head of a pin 46, which pin is engaged as a force fit in a hole 48 formed in the boss 44 and the plate 2. The mounting of the idler wheel 42 is identical to that of the idler wheel 40.

It is clear that the use of the idler wheels 40 and 42 enables use to be made of pinions approximately the same diameter on the minute and hour arbors without it being necessary, for this purpose, to make the gear train substantially more complicated. In addition the idler wheels 40 and 42, since they are mounted on bosses formed on the plate 2, occupy only part of the thickness of the movement.

Due to this arrangement embodying the invention, the watch movement which is circular, has a minimum diameter for any given diameter of the cell. However, the thickness of the movement is not increased, since no wheel or pinion overlaps the cell.

Figure 3:
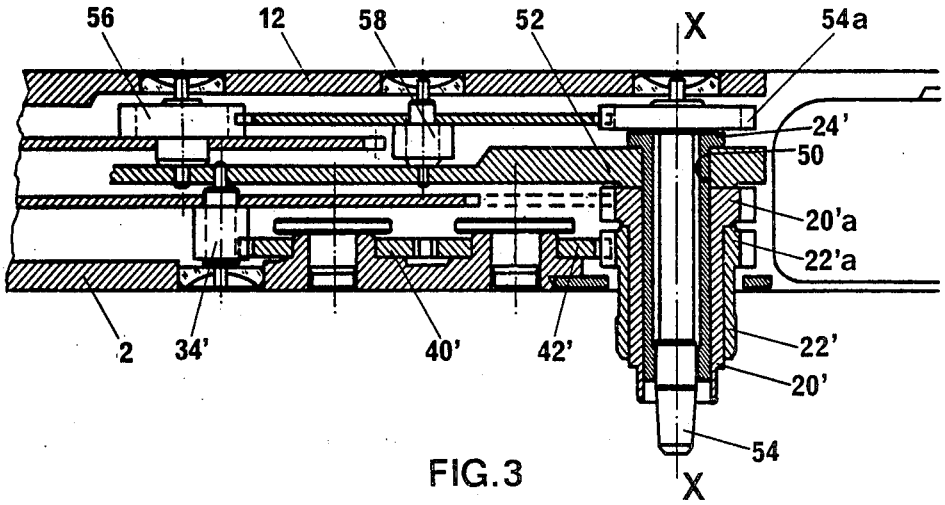
FIG. 3 is a vertical section, partly broken away, of a movement comprising a second hand.

FIG. 3 illustrates part of the movement in the case where the latter is also provided with a second hand. In this case, the movement comprises the hour arbor 22' with its pinion 22'*a*, the minute arbor 20' which is a cannon wheel and is formed with the pinion 20'*a*, and the fixed axis pin 24' which in this case is hollow. The axis pin 24' is engaged as a force fit in an opening 50 formed in an intermediate bridge plate 52 of the watch movement. Inside the hollow axis pin 24' is mounted a solid second arbor 54. This last-mentioned arbor extends completely through the hollow axis pin 24' and is provided at its end with a pinion 54*a*, the external diameter of which is substantially equal to that of the pinions 22'*a* and 20'*a*. The gear train which drivably connects the shaft of the motor 8 to the several arbors 20', 22' and 54 is advantageously arranged as follows: a wheel 48 transmits the motion between the rotor pinion 8*b* and the pinions 54*a* of the second arbor. The wheel 58 also drives a wheel 56, the wheels 56 and 58 being mounted between the bridge plate 12 and the intermediate bridge plate 52. The wheel 56 is coupled via a wheel (not shown) to the wheel 34' which is the equivalent of the wheel 34 of FIG. 2. This wheel 34', which is mounted between the plate 2 and the intermediate bridge plate 52, is drivably connected on the one hand directly to the pinion 20'*a* on the arbor 20' and on the other hand to two idler pinions 40', 42' which are similar to the pinions 40 and 42, but are mounted between the plate 2 and the intermediate bridge plate 52. The pinion 42' is in mesh with the pinion 22'*a* on the hour arbor.

In this arrangement the various different elements of the gear train are disposed in such a manner that the plan projections thereof on to the plane of FIG. 1 fall outside the plan projection of the cell on to this same plane.

While there has been shown and described illustrative embodiments of the invention, it will be understood by those skilled in the art various other modifications may be made within the principles of the invention and under the scope of the appended claims.

What is claimed is:

1. A movement for an electronic watch provided with at least two hands comprising:

a motor;

a cell for supplying said motor;

a first arbor for carrying a minute hand and comprising a single toothed pinion, integral with said first arbor;

a second arbor, coaxial to said first arbor, for carrying an hour hand and comprising a single toothed pinion, integral with said second arbor, said two arbors being adjacent and without overlapping with said cell;

a gear train for connecting said motor to said pinions, comprising a minute wheel and an hour pinion, rigidly joined one to the other, to form a single piece, and two idler wheels, at least one idler wheel gearing with one of said pinions and the other wheel gearing with said single piece.

2. The movement of claim 1 wherein one of said idler wheels is gearing with said hour pinion and the other idler wheel is gearing with said first idler wheel and with the pinion of the arbor which carries the hour hand.

* * * * *